US008458886B2

(12) United States Patent
Masson et al.

(10) Patent No.: US 8,458,886 B2
(45) Date of Patent: Jun. 11, 2013

(54) PROCESS FOR MANUFACTURING A METAL PART REINFORCED WITH CERAMIC FIBRES

(75) Inventors: Richard Masson, Buc (FR); Dominique Ducos, Savigny sur Orge (FR)

(73) Assignee: Messier-Bugatti-Dowty, Velizy-Villacoublay (FR)

( * ) Notice: Subject to any disclaimer, the term of this patent is extended or adjusted under 35 U.S.C. 154(b) by 400 days.

(21) Appl. No.: 12/810,949

(22) PCT Filed: Dec. 24, 2008

(86) PCT No.: PCT/EP2008/068294

§ 371 (c)(1),
(2), (4) Date: Oct. 4, 2010

(87) PCT Pub. No.: WO2009/083573

PCT Pub. Date: Jul. 9, 2009

(65) Prior Publication Data

US 2011/0005061 A1 Jan. 13, 2011

(30) Foreign Application Priority Data

Dec. 28, 2007 (FR) ..... 07 09172

(51) Int. Cl.

| | |
|---|---|
| ***B23P 17/00*** | (2006.01) |
| ***B23P 13/04*** | (2006.01) |
| ***H02K 5/02*** | (2006.01) |
| *B64C 25/00* | (2006.01) |
| *B21D 53/78* | (2006.01) |
| *B21K 3/04* | (2006.01) |

(52) U.S. Cl.
USPC ..... 29/527.1; 29/598; 29/419.1; 29/525.14; 29/557; 29/889.722

(58) Field of Classification Search
USPC ..... 244/37, 100 R; 29/897.2, 419.1, 29/525.14, 557, 889.722, 598, 148
See application file for complete search history.

(56) References Cited

U.S. PATENT DOCUMENTS 1,359,065 A * 11/1920 Holmberg ..... 52/35
3,333,334 A * 8/1967 Kuliczkowski et al. ..... 29/604

(Continued)

FOREIGN PATENT DOCUMENTS

EP 0 831 154 3/1998
EP 0 997 549 5/2000

(Continued)

OTHER PUBLICATIONS

U.S. Appl. No. 12/810,751, filed Jun. 25, 2010, Masson, et al.

(Continued)

*Primary Examiner* — Essama Omgba
*Assistant Examiner* — Darrell C Ford
(74) *Attorney, Agent, or Firm* — Oblon, Spivak, McClelland, Maier & Neustadt, L.L.P.

(57) ABSTRACT

A process for manufacturing a metal part reinforced with ceramic fibers, in which: a housing for an insert is machined in a metal body having an upper face; an insert formed from a fiber bundle having a metal matrix is placed in the housing; a metal cover is placed on the metal body so as to cover the insert; the cover is welded onto the metal body; the assembly including the metal body with the cover undergoes a hot isostatic compression treatment; and the treated assembly is machined to obtain the part. The insert is a rectilinear insert and the housing forms a rectilinear groove that extends beyond the insert and is open at each end, the groove being filled by a tab when the cover is placed on the metal body.

9 Claims, 3 Drawing Sheets

U.S. PATENT DOCUMENTS

| | | | | |
|---|---|---|---|---|
| 3,571,901 | A * | 3/1971 | Sara | 29/419.1 |
| 3,754,839 | A * | 8/1973 | Bodman | 416/195 |
| 3,765,796 | A * | 10/1973 | Stargardter et al. | 416/244 R |
| 3,844,019 | A * | 10/1974 | Shwayder et al. | 419/61 |
| 4,587,177 | A * | 5/1986 | Toaz et al. | 428/614 |
| 4,867,644 | A * | 9/1989 | Wright et al. | 416/230 |
| 4,919,594 | A * | 4/1990 | Wright et al. | 416/230 |
| 5,222,296 | A * | 6/1993 | Doorbar et al. | 29/889.21 |
| 5,225,015 | A * | 7/1993 | Allaire et al. | 156/89.26 |
| 5,431,984 | A * | 7/1995 | Keck et al. | 428/175 |
| 5,561,173 | A * | 10/1996 | Dry | 523/218 |
| 5,945,801 | A * | 8/1999 | Yamada et al. | 318/701 |
| 5,946,801 | A * | 9/1999 | Twigg et al. | 29/889.71 |
| 5,989,334 | A * | 11/1999 | Dry | 106/677 |
| 6,186,768 | B1 * | 2/2001 | Schmitt | 425/550 |
| 6,623,678 | B2 * | 9/2003 | Anderson | 264/162 |
| 6,630,093 | B1 * | 10/2003 | Jones | 264/401 |
| 6,745,819 | B2 * | 6/2004 | Kamm et al. | 164/113 |
| 7,000,499 | B2 * | 2/2006 | Valle | 74/594.1 |
| 7,325,306 | B2 * | 2/2008 | Twigg | 29/889.71 |
| 7,343,677 | B2 * | 3/2008 | Twigg | 29/889.71 |
| 7,516,548 | B2 * | 4/2009 | Twigg | 29/889.71 |
| 7,584,571 | B2 * | 9/2009 | Ryan | 43/18.1 CT |
| 7,781,698 | B2 * | 8/2010 | Franchet et al. | 219/121.64 |
| 2003/0012518 | A1 * | 1/2003 | Tomaru et al. | 385/76 |
| 2004/0144712 | A1 * | 7/2004 | Stroh et al. | 210/321.89 |
| 2005/0011591 | A1 * | 1/2005 | Murty et al. | 148/400 |
| 2005/0086789 | A1 * | 4/2005 | Twigg | 29/505 |
| 2005/0103827 | A1 * | 5/2005 | Twigg | 228/194 |
| 2005/0166386 | A1 * | 8/2005 | Twigg | 29/458 |
| 2005/0210676 | A1 * | 9/2005 | Chiu | 29/896.9 |
| 2005/0251260 | A1 * | 11/2005 | Gerber et al. | 623/17.13 |
| 2006/0024490 | A1 * | 2/2006 | Werner et al. | 428/323 |
| 2006/0166027 | A1 * | 7/2006 | Amusin et al. | 428/614 |
| 2006/0244165 | A1 * | 11/2006 | Huang | 264/29.5 |
| 2006/0269746 | A1 * | 11/2006 | Franchet et al. | 428/364 |
| 2007/0045251 | A1 * | 3/2007 | Franchet et al. | 219/121.64 |
| 2007/0051455 | A1 * | 3/2007 | Franchet et al. | 156/169 |
| 2007/0181775 | A1 * | 8/2007 | Fick et al. | 249/175 |
| 2008/0176673 | A1 * | 7/2008 | Morales et al. | 473/346 |
| 2010/0055637 | A1 * | 3/2010 | Rodriguez et al. | 433/10 |

FOREIGN PATENT DOCUMENTS

| | | |
|---|---|---|
| EP | 1 726 676 | 11/2006 |
| EP | 1 726 677 | 11/2006 |

OTHER PUBLICATIONS

U.S. Appl. No. 12/810,874, filed Jun. 28, 2010, Masson.
U.S. Appl. No. 13/002,514, filed Jan. 4, 2011, Dunleavy, et al.
U.S. Appl. No. 13/002,580, filed Jan. 4, 2011, Dunleavy, et al.

* cited by examiner

PROCESS FOR MANUFACTURING A METAL PART REINFORCED WITH CERAMIC FIBRES

FIELD

The present invention relates to the manufacture of metal parts having internal reinforcements formed from ceramic fibers, and comprising the incorporation of an insert made of a composite of the type consisting of ceramic fibers in a metal matrix.

BACKGROUND

For the purpose of reducing the weight of metal parts while giving them greater strength, especially in tension or in compression, it is known to incorporate ceramic fibers thereinto. For example, these are silicon carbide (SiC) fibers which have a tensile strength and a compressive strength that are substantially greater than that of a metal such as titanium.

The manufacture of these parts involves the prior formation of inserts from ceramic filaments with a metal matrix, which inserts comprise a ceramic fiber coated with metal. They are also referred to as CMM fibers or coated filaments. The metal gives the elasticity and flexibility necessary for handling them.

A known process for manufacturing such reinforced parts comprises the production of a winding of a coated filament around a mandrel. The winding is then introduced into a main metal body or container in which a slot forming the housing for the insert has been machined beforehand. The depth of the slot is greater than the height of the winding. A cover is placed on the container and welded to its periphery. The cover has a tenon having a shape complementary to that of the slot, and its height is adapted to that of the winding placed in the slot so as to fill the slot. Next, a hot isostatic pressing step is carried out, during which the cover is deformed and the winding is compressed by the tenon.

The hot isostatic pressing technique consists in placing the part in an enclosure subjected to high pressure, of the order of 1000 bar, and also to high temperature, of the order of 1000° C., for a few hours.

During this treatment, the metal sheaths of the coated filaments are welded together and to the walls of the slot by diffusion, to form a dense assembly composed of a metal alloy within which the ceramic fibers annularly extend. The part obtained is then machined to the desired shape.

The process serves for the manufacture of axisymmetric aeronautical parts, such as rotor disks or blisks (integrally bladed disks), but also shafts, actuator bodies, casings, etc.

It is difficult to machine the slot in the main body, especially because of the small radii in the bottom of the slot. This small radius is necessary in order to house the insert, which has a rectangular cross section. The machining of the corresponding tenon in the cover is not easy either, because of the non-open-ended corners.

SUMMARY

The Applicant has developed a process for manufacturing parts of elongate shape that incorporate an insert with straight portions contributing to the transmission of the unidirectional tensile and/or compressive forces. This process is described in patent application FR 07/05453 of Jul. 26, 2007. The Applicant has also developed a process for manufacturing a straight insert. This process consists in producing an insert blank in the form of a winding, in compacting said blank in a container by hot isostatic pressing and then in machining the straight inserts in the compacted container. Such a process is described in patent application FR 07/05454 of Jul. 26, 2007.

However, when the parts to be produced are not axisymmetric, but are long, with an oval shape or else with straight portions, precise adjustment over long lengths is difficult to achieve. This is even more difficult for inserts formed from very rigid coated filaments, because of the ceramic fibers that require the formation of housings in which they fit perfectly and must not allow any fiber to escape.

Instead of manufacturing the insert separately and then transferring it to the slot of the main body, patent FR 2 886 290 in the name of SNECMA proposes, according to one embodiment, to produce the winding directly on the main body. Instead of a slot, two shoulders are provided in the body. The first one has a bearing surface for the direct winding of a coated filament. This surface is parallel to the winding direction. When the winding has been completed, the slot is reconstituted by placing a part on the main body which has a shape complementary to that of a second shoulder forming a step in relation to the first shoulder. The cover with the tenon is then positioned on the insert that has just been wound and the assembly undergoes a compacting operation. The manufacturing problem is only partly solved by this solution, since the assembly operation remains complicated.

Thus, the current manufacturing techniques make it possible to create metal parts that include one or more reinforcements made of metal-matrix composites from a winding of coated fibers and a container—a body and a cover. These structures are very effective but have a high manufacturing cost. In particular, the machining of the main body of the container with its cover represents a large fraction of the total cost of the parts.

The Applicant sets one objective of improving the process for manufacturing parts of elongate shape for the purpose of simplifying the steps of the production operation and of reducing the costs.

This objective is achieved, in accordance with the invention, with a process for manufacturing a metal part reinforced with ceramic fibers, in which:

- a housing for an insert is machined in a metal body having an upper face;
- an insert formed from a bundle of fibers having a metal matrix is placed in the housing;
- a metal cover is positioned on the body so as to cover the insert;
- the cover is welded onto the metal body;
- the assembly, namely the metal body with the cover, is treated by hot isostatic pressing; and
- said treated assembly is machined in order to obtain said part, characterized in that the insert is straight and the housing forms a straight slot open at each end, said slot being filled by a tongue at the moment of closure by the cover.

The invention is based on the observation that machining a straight slot passing through the entire body of the container is much simpler to control than machining a non-open-ended slot. The solution of the invention is particularly advantageous for the positioning of two inserts, of elongate shape, placed along two straight branches that are not necessarily parallel. According to the prior art, to obtain two longitudinal internal reinforcements, an insert of annular shape with two straight branches joined together by two circularly arcuate portions is produced beforehand. The housing is then machined according to the precise shape of the insert. Adjusting the shape of the housing to that of the insert proves to be a very tricky and expensive operation. Thus, elimination of the rounded portions makes the machining and positioning operations simpler, without in the end sacrificing the strength of the part since the fibers work essentially along their longitudinal direction in the central section of the part.

In practice, the cover comprises a plate and one or more tongues integral with the plate. More particularly, the plate and the tongue(s) are obtained by machining one and the same thick plate. According to one embodiment, the tongue(s) and the plate form separate parts.

Preferably, a bevel is machined on the upper edge of the slot forming the housing for the insert. This bevel allows the tongue to be progressively pressed down on the insert and makes it possible to obtain a continuous line of deformation, i.e. one with no discontinuity.

The invention is particularly advantageous when the insert has a polygonal, especially rectangular, cross section. The cross section may also be oval or circular. The insert is either formed from metal-coated fibers assembled into a bundle or formed from ceramic fibers in a single metal matrix.

BRIEF DESCRIPTION OF THE DRAWINGS

The invention will now be described in greater detail with reference to the appended drawings in which.

DESCRIPTION OF PREFERRED EMBODIMENTS

Figure 1:
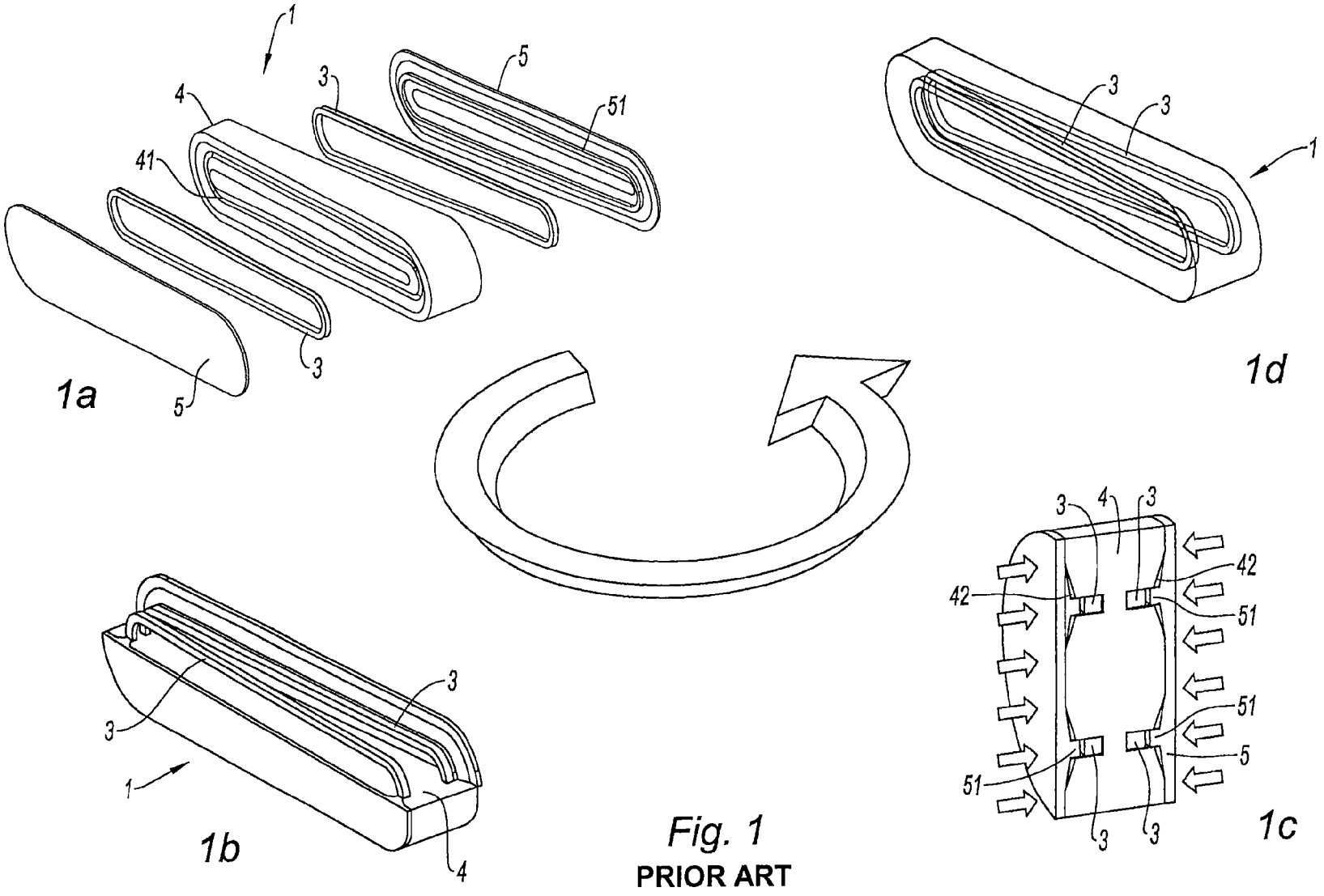
Fig. 1 PRIOR ART
FIG. 1 shows the various steps 1*a*, 1*b*, 1*c*, 1*d* in the manufacture of a part of elongate shape according to the known prior art of the present Applicant.

FIG. 1, taken from patent application FR 07/05453, shows a container 1 with a main body 4 of elongate shape, intended to form a connecting rod, for example for a landing gear.

A slot 41 is machined on each of the two faces of the body 4. This slot serves to house an insert 3, which comprises two straight portions, which are not necessarily parallel to one another, joined at the ends by circularly arcuate portions. The inserts are of the type having ceramic fibers coated with a metal, such as titanium. The slots and the inserts have complementary shapes so that the insert is fitted into the slot with no clearance. It should be noted that the slot in the container and the tenon on the cover must fit together perfectly in order to prevent the fibers, which have a very small diameter, 0.25 mm, from being able to escape during the hot isostatic pressing. Two covers 5 are provided with a projecting portion, which forms a tenon 51, and cover the faces of the body 4. The tenon presses down on the insert housed in the slot and fills the latter. The cover 5 is welded to the body 4, for example by electron beam welding, a vacuum being created inside the container. The container is visible in FIG. 1*b* and is partly cut away in order to show the inserts. The container is then placed in an enclosure in order to undergo a hot isostatic pressing treatment. The cross section of the container in FIG. 1*c* shows that the edges 42 of the slot 41 are beveled so as to leave a clearance with that portion of the cover 5 adjacent to the tenon 51. During the hot isostatic pressing operation, the pressure is exerted along the direction perpendicular to the surface of the cover, causing the covers to sag. The pressure and the heat, of around 1000 bar and 1000° C., allow the metal of the matrix to occupy the spaces between the coated filaments constituting the insert. The volume of the insert decreases by about 23%. The tenon is thus moved downward and the clearance on either side of the tenon is absorbed. At the end of the procedure, the metal has fused and the container compacted. The part is thus reinforced by the filaments embedded in the mass of metal. FIG. 1*d* shows the part blank obtained with two inserts visible as if the part blank were transparent. The part blank is then machined so as to obtain the part 8 shown in FIG. 2. This part 8 has holes 81 between the branches 82. The ceramic fibers are incorporated in the branches 82 for transmitting the tensile and compressive forces. The inserts used are of annular shape but, as described in patent application FR 07/05454, they may be formed from straight elements, as bars. In the latter case, the straight elements are incorporated into the container after they have been compacted beforehand.

The solution of the invention enables such parts to be obtained more economically.

Figure 3:
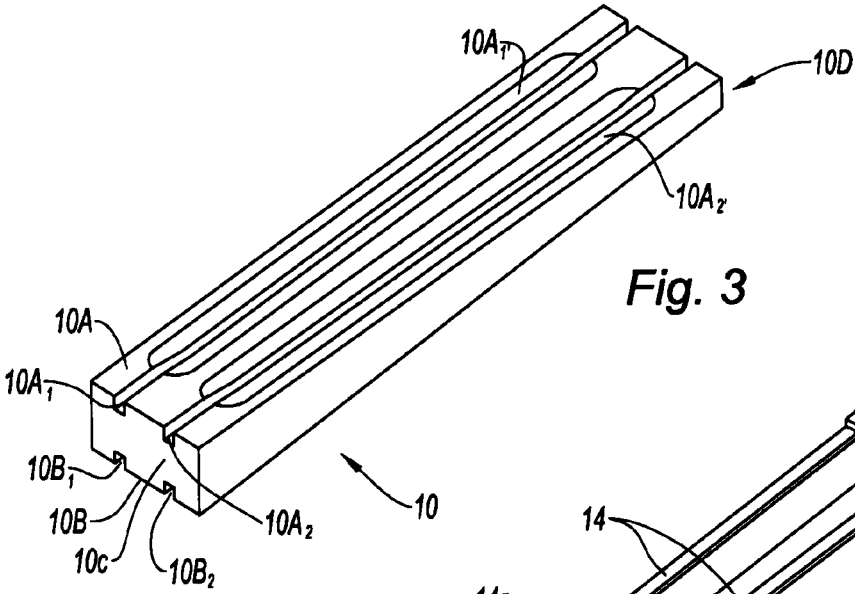
FIG. 3 shows, in perspective, a metal body machined in accordance with the invention.
Figure 4:
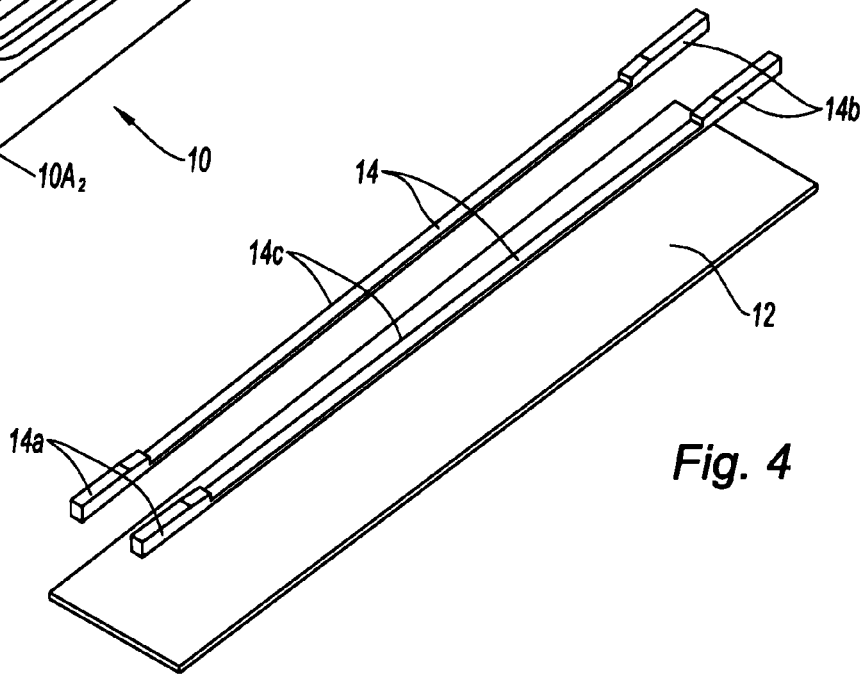
FIG. 4 shows, in perspective, tongues associated with a plate in order to form the cover closing the metal body of FIG. 3.
Figure 5:
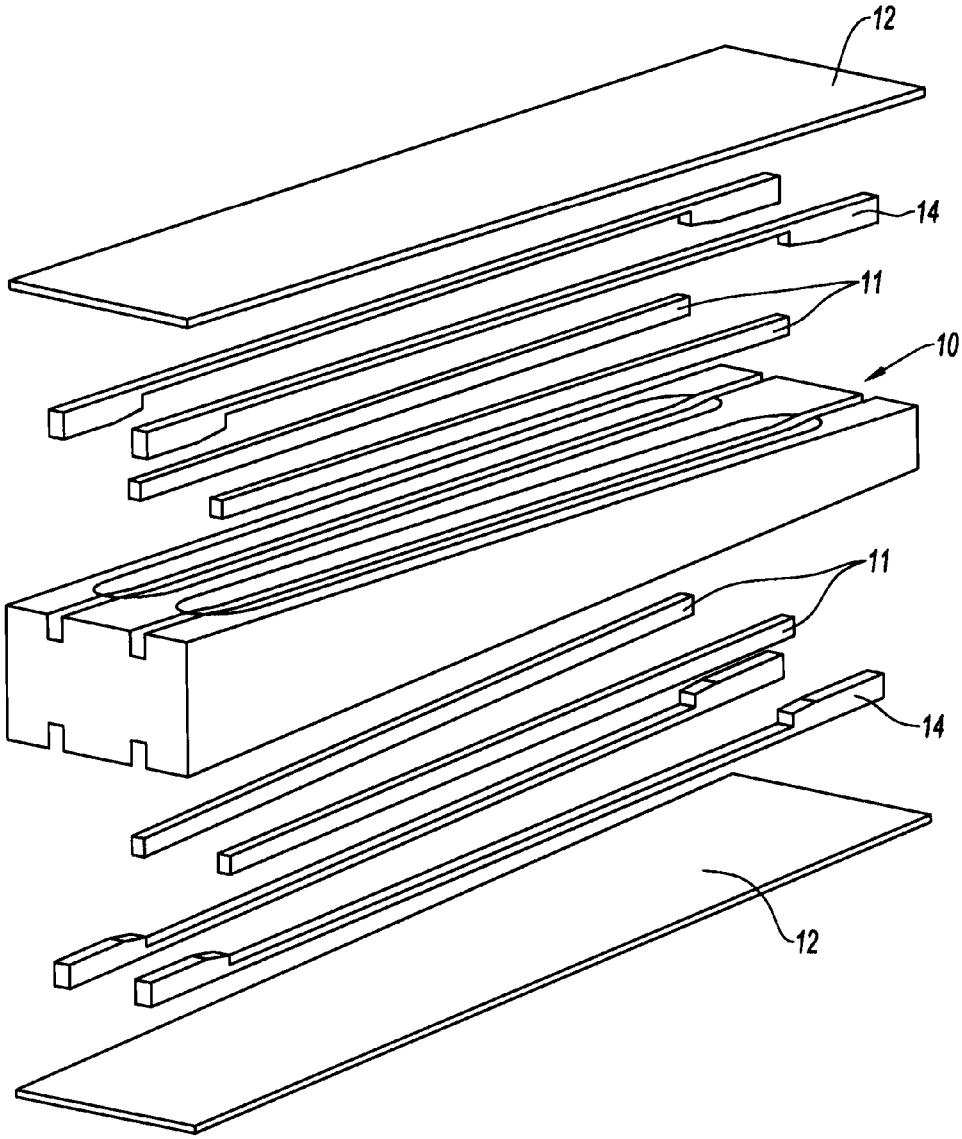
FIG. 5 shows, in an exploded view in perspective, the various components before they are assembled.

FIGS. 3, 4 and 5 show a metal body 10 of elongate shape with, in relation to each figure, an upper face 10A and a lower face 10B. Two straight slots 10A1, 10A2 and 10B1, 10B2 are machined in each of the two faces. The slots pass through the body 10 in the length direction and emerge in the two end faces 10C and 10D. The length of the slots is equal to the length L of the body 10. They serve as housings for the straight inserts 11, formed from bundles of coated ceramic fibers, the inserts having a length 1 smaller than L. The upper edge 10A1', 10A2' of that portion of the slot forming the insert housing is beveled. A tongue 14 covers each insert 11 placed in its housing. The tongue 14, having the same length L as the body 10, includes a recess in the height direction so as to form two end portions 14*a* and 14*b* and a central portion 14*c* of length 1. The plate 12 covers the upper face 10A, or the lower face 10B, of the body 10. The height of the tongue is equal to the depth of the slot, which must be sufficient to contain the insert 11.

The manufacture of an example of a part according to the invention with 4 inserts thus comprises the following steps:

- a metal body 10, for example made of a titanium alloy, with an upper flat face and a lower flat face, is prepared;
- two open straight slots 10A1, 10A2 and 10B1, 10B2 are machined on each of the two faces, the upper face and the lower face, respectively. The slots open onto the end faces of the body. This operation is relatively simple as only the depth and the width of the slot are considered;
- two beveled central zones 10A1', 10A2' and 10B1', 10B2', respectively, are machined on the free faces of the slots, the length corresponding to that of the inserts;
- the inserts 11 are placed in the slots, in the beveled zones. According to a first embodiment, the inserts are formed from an assembled bundle of coated straight fibers. According to a preferred second embodiment, the inserts are premanufactured using the method described in patent application FR 07/05454. In this case, the inserts form bars with ceramic fibers in a metal matrix. These are straight elements already compacted by hot isostatic pressing;
- the tongues 14 are placed on the inserts 11 with the central portion 14*c* along the insert and the end portions 14*a* and 14*b* on the ends of the insert 11;
- the plates are positioned and vacuum-welded to the faces of the body 10;
- the containers thus prepared are put into a hot isostatic pressing enclosure; and heat and compression are applied in order to compact the container.

Figure 2:
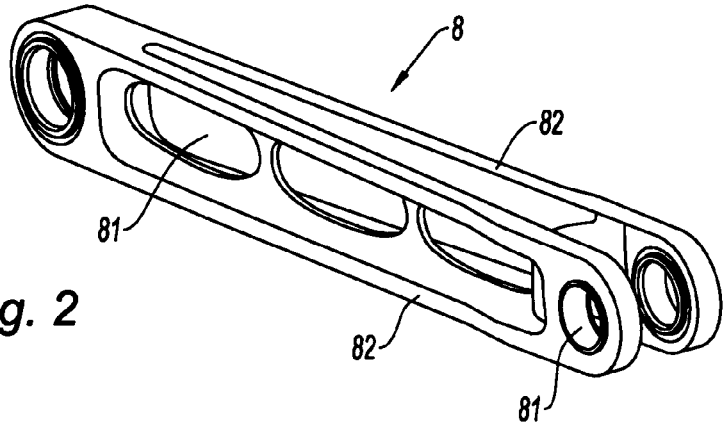
FIG. 2 shows an example of a part obtained after machining a container incorporating inserts.

The blank obtained is ready to be machined. For example, the part shown in FIG. 2 is obtained.

Instead of separately attaching the tongues 14 and the plate 12, it is possible to produce these two portions as a single part by machining the tongues from a thick plate. The result obtained is a priori the same.

The process of the invention thus makes it possible to produce any part of elongate shape incorporating one or more straight inserts.

The invention claimed is:

1. A method for manufacturing a metal part reinforced with ceramic fibers, comprising:

machining at least one housing to form a straight slot to receive an insert in a metal body having an upper face;

placing at least one insert formed from a bundle of fibers having a metal matrix into the straight slot of the housing;

positioning a metal cover on the metal body so as to cover the insert;

welding the cover onto the metal body;

treating an assembly of the metal body with the welded cover by hot isostatic pressing; and machining the treated assembly to obtain the part, wherein the insert is straight and the housing is machined to form the straight slot which extends beyond the insert and is open at each end, the straight slot being filled by a tongue when positioning the metal cover on the metal body.

2. The process as claimed in claim 1, in which the tongue is integral with a plate forming the metal cover.

3. The process as claimed in claim 2, in which the tongue integral with the plate is obtained by machining a thick plate to form the metal cover.

4. The process as claimed in claim 1, wherein the tongue is separate from a plate of the metal cover.

5. The process as claimed in claim 1, in which the machining at least one housing includes machining a bevel on an upper edge of the straight slot for receiving the insert.

6. The process as claimed in claim 1, in which the insert has a polygonal, or rectangular, or oval, or circular, cross section.

7. The process as claimed in claim 1, wherein the insert is formed from metal-coated fibers assembled into the bundle.

8. The process as claimed in claim 1, wherein the insert is formed from a bundle of ceramic fibers in the metal matrix.

9. The process as claimed in claim 1, wherein at least first and second inserts are placed in the metal body.

* * * * *